US006575775B2

(12) United States Patent
Hasegawa et al.

(10) Patent No.: US 6,575,775 B2
(45) Date of Patent: Jun. 10, 2003

(54) CONNECTOR WITH SHORTING TERMINAL

(75) Inventors: Teruaki Hasegawa, Yokkaichi (JP); Naova Kurimoto, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/833,072

(22) Filed: Apr. 12, 2001

(65) Prior Publication Data

US 2001/0036768 A1 Nov. 1, 2001

(30) Foreign Application Priority Data

Apr. 12, 2000 (JP) ..... 2000-110650

(51) Int. Cl.[7] ..... H01R 29/00; H01R 3/00
(52) U.S. Cl. ..... 439/188; 439/488
(58) Field of Search ..... 439/188, 488, 439/489, 595

(56) References Cited

U.S. PATENT DOCUMENTS 5,466,168 A 11/1995 Liebich et al.
6,171,124 B1 * 1/2001 Kojima ..... 439/188
6,247,957 B1 * 6/2001 Hasegawa ..... 439/352

FOREIGN PATENT DOCUMENTS

EP 0852 413 A1 7/1998
EP 0905 823 A1 3/1999
JP 11-150566 * 5/1999 ..... H01R/13/627
JP 11-329604 11/1999

* cited by examiner

*Primary Examiner*—Tulsidas Patel
*Assistant Examiner*—Chandrika Prasad
(74) *Attorney, Agent, or Firm*—Banner & Witcoff, Ltd.

(57) ABSTRACT

A connector is provided with a shorting terminal. Male terminal fittings 12 protrude into a hood 11 of a male housing 10, a female housing 20 fitting into this hood 11. A left half of a lower portion of the hood 11 protrudes downwards, a shorting terminal housing recess 70 being provided at this location, this recess 70 housing a shorting terminal 60. The shorting terminal 60 has four resilient contacts 62 which make contact with the male terminal fittings 12 and short-circuit them. The shorting terminal 60 can be inserted, from the posterior of the male housing 10, into the recess 70. A misalignment preventing wall 75 protrudes at an anterior end of the recess 70. A protruding anterior end face of the misalignment preventing wall 75 forms a unified face with a right half of the lower portion of the hood 11. As a result, an opening area of the hood 11 of the male housing 10 is approximately the same shape as a fitting area R of the female housing 20, thereby preventing misalignment when fitting is carried out. The misalignment preventing wall 75 ensures that only a small part of the shorting terminal 60 is exposed to the exterior.

7 Claims, 12 Drawing Sheets

CONNECTOR WITH SHORTING TERMINAL

TECHNICAL FIELD

The present invention relates to an electrical connector provided with a shorting terminal.

BACKGROUND TO THE INVENTION

One example of a connector provided with a shorting terminal is described in JP-11-329604. As shown in FIG. 23 of this specification, a connector has a female housing 7 capable of being fitted into a hood 2 of a male housing 1. A plurality of male terminal fittings 3 protrude into the hood, and a shorting terminal 4 is attached to this hood 2, the shorting terminal 4 connecting a plurality of tabs 3A of the male terminal fittings 3, thereby short-circuiting these male terminal fittings 3. As the two housings 1 and 7 are fitted together, an outer face of the female housing 7 makes contact with the shorting terminal 4. As the fitting progresses, the female housing 7 releases the short-circuiting state of the shorting terminal 4 with the male terminal fittings 3.

In this connector, the shorting terminal 4 is provided in a location where the opening area of the hood 2 of the male housing 1 is greater than the area of a fitting end face of the female housing 7. The entirety of the shorting terminal 4 protrudes towards the exterior of the opening of the hood 2. Consequently, a protecting cover 5 capable of being rocked open and closed is attached resiliently by a spring 6 to an outer face of the male housing 1, this protecting cover 5 covering the open portion of the hood 2 and protecting the shorting terminal 4. A misalignment preventing rib 8 protrudes from an upper face of the female housing 7, this misalignment preventing rib 8 preventing the female housing 7 from being inserted in an inclined state into the hood 2 when the two housings 1 and 7 are fitted together.

In this connector, the misalignment preventing rib 8 is provided on the female housing 7 and the protecting cover 5 is provided on the male housing 1. As a result, the connector has a complex configuration. In particular, the attachment device of the protecting cover 5 requires the spring 6 and other components, and the number of components becomes large. Simplifying this configuration would be desirable.

Furthermore, a jig is used to attach the shorting terminal 4 within the male housing 1 from the anterior via the opening portion of the hood 2. However, the tabs 3A of the male terminal fittings 3 protrude from the innermost portion of the hood 2. Consequently, the jig may interfere with these tabs 3A of the male terminal fittings 3 when the shorting terminal 4 is being attached, thus bending the male terminal fittings 3 in an undesirable manner.

The present invention has taken the above problems into consideration, and aims to rectify them.

SUMMARY OF THE INVENTION

According to a first aspect of the invention there is provided an electrical connector comprising a first housing provided with a hood, and a second housing insertable in the hood in a fitting direction and to a fully fitted condition, said first housing having a plurality of terminal fittings protruding into said hood, and a resilient shorting terminal having one or more resilient contacts, said shorting terminal being in contact with two or more of said terminal fittings and adapted to be separated therefrom by said second housing on insertion to the fully fitted condition, wherein said first housing further includes a wall at the mouth of said hood and extending into said hood substantially transverse to said fitting direction, said wall overlapping said shorting terminal in a direction transverse to said fitting direction. Such a wall can avoid misalignment on insertion of the second housing into the hood, by making the hood aperture a close fit around the second housing. Furthermore the wall protects the shorting terminal from inadvertent damage, for example during transit.

According to a second aspect of the invention there is provided an electrical connector comprising a first housing provided with a hood, and a second housing insertable in the hood in a fitting direction and to a fully fitted condition, said first housing having a plurality of terminal fittings protruding into said hood, and a resilient shorting terminal having one or more resilient contacts, said shorting terminal being in contact with two or more of said terminal fittings and adapted to be separated therefrom by said second housing on insertion to the fully fitted condition wherein said first housing includes an insertion aperture for said shorting terminal, said aperture facing outwards in the opposite direction to said hood.

Insertion of the shorting terminal from the rear side ensures that inadvertent damage to the terminal fittings is avoided.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

Figure 1:
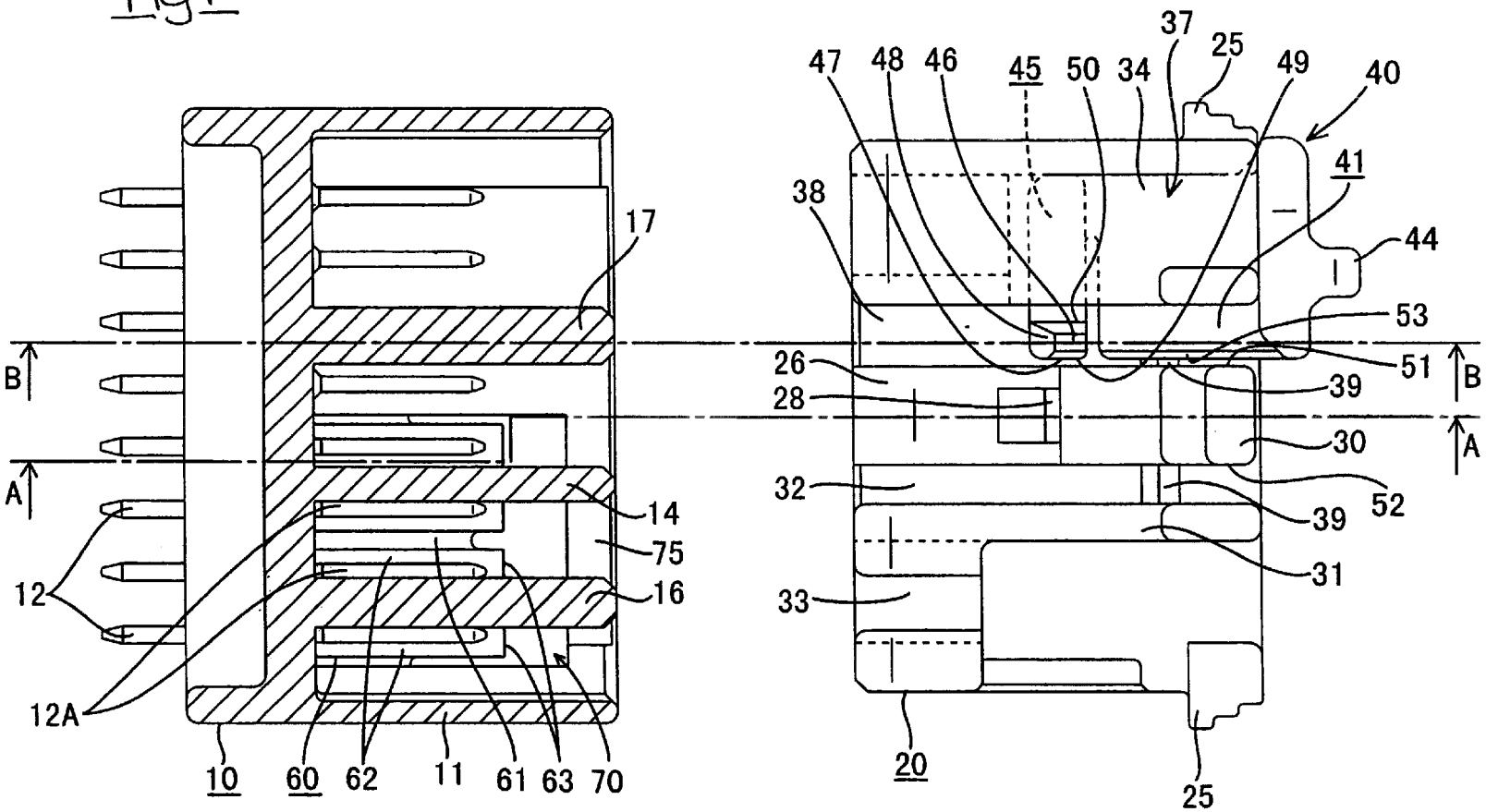
FIG. 1 is a partially cut-away plan view of an embodiment of the present invention, showing a connector prior to fitting.

An embodiment of the present invention is described below with the aid of FIGS. 1 to 22. As shown in FIG. 2, a connector of the present embodiment has a female connector housing 20 that fits into a hood 11 provided on a male connector housing 10. A shorting terminal 60 is attached to the male housing 10, and a detecting member 40 is attached to the female housing 20. The fitting face sides of the two housings 10 and 20 are considered as the anterior sides.

Figure 2:
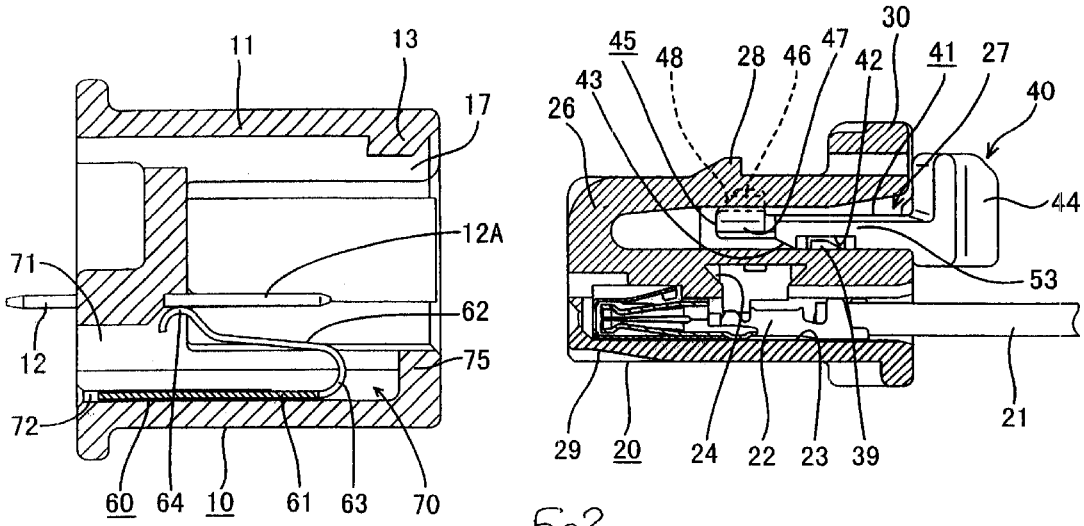
FIG. 2 is a cross-sectional view along the line A—A of FIG. 1.

As shown in FIGS. 1 and 2, the cylindrical hood 11 is provided on an anterior portion of the male housing 10. This hood 11 is open to the anterior, and the female housing 20 can be fitted therein. Eight male terminal fittings 12 (these being tab shaped at both ends) are aligned in a widthwise direction within the male housing 10. Anterior portions 12A of these male terminal fittings 12 protrude into the hood 11, and posterior portions thereof are located to the outer posterior portion of the male housing 10. A left half (relative to FIG. 4) of a lower portion of the hood 11 protrudes downwards, this protruding portion being provided with a shorting terminal housing recess 70 for housing the shorting terminal 60. The shorting terminal 60 is capable of making contact with the anterior portions 12A of four of the male terminal fittings 12 protruding into the hood 11 (these four male terminal fittings 12 being located at the left side), thereby short-circuiting these male terminal fittings 12. The configuration of the shorting terminal 60 and the shorting terminal housing recess 70 will be described later.

As shown in FIG. 2, a locking claw 13 protrudes downwards from a central portion of an upper face of the hood 11, this locking claw 13 engaging with a locking arm 26 of the female housing 20. The left side (relative to FIG. 4) of the locking claw 13 has a guiding rib 14 protruding downwards therefrom, and a releasing rib 17 protrudes downwards from the right side of the locking claw 13. As shown in FIG. 1, anterior end faces of the guiding rib 14 and the releasing rib 17 are even with an anterior end face of the hood 11.

Figure 4:
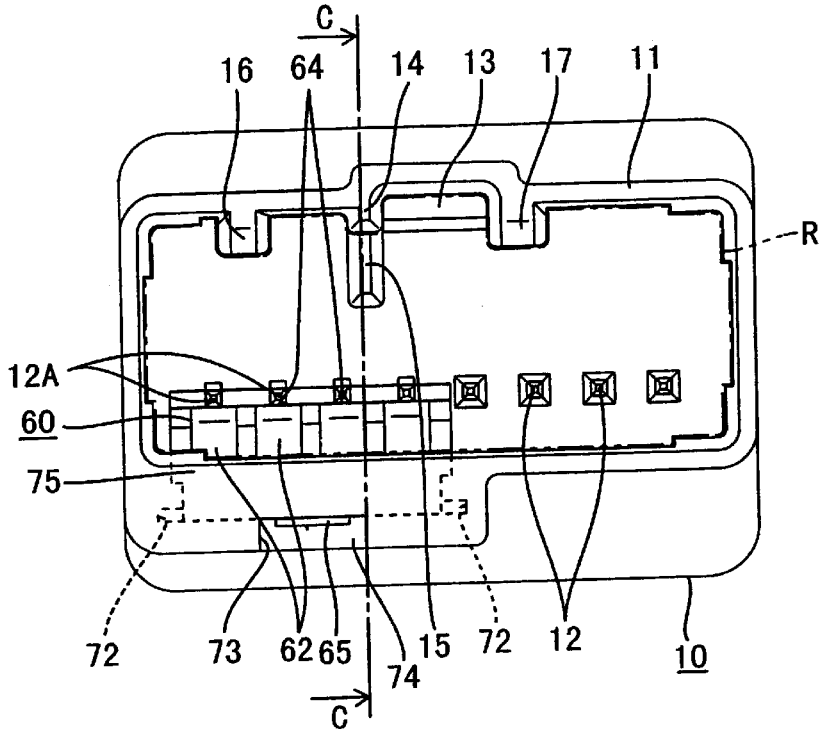
FIG. 4 is a front view of a male housing.
Figure 7:
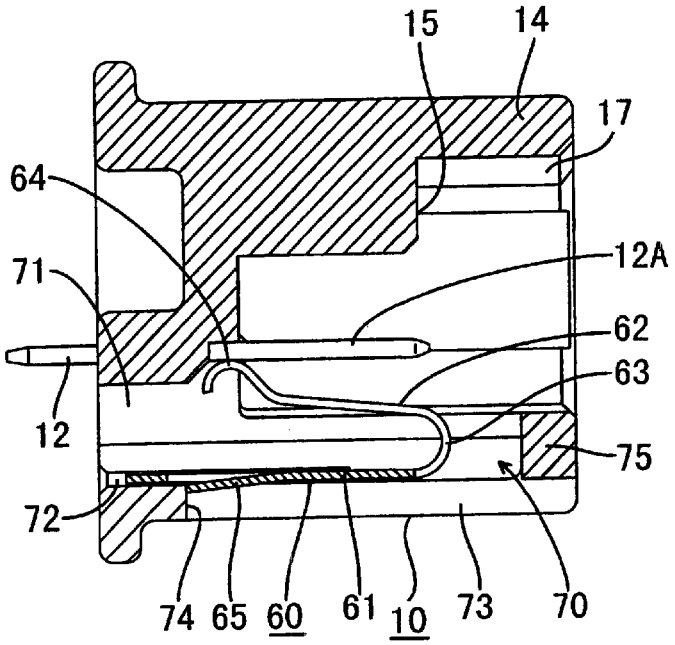
FIG. 7 is a cross-sectional view along the line C—C of FIG. 4.

The fitting operation of the two housings 10 and 20 is guided by the guiding rib 14 fitting into a guiding groove 32 formed in the female housing 20. As shown in FIG. 7, a block-like cut-away portion 15 having a specified size is formed at a lower portion of an anterior end of the guiding rib 14. As shown in FIG. 4, a guiding rib 16 is provided somewhat to the left of the guiding rib 14 and is separated from it by a space. It has the same function as the guiding rib 14, but differs from the guiding rib 14 in that it does not have a cut-away portion 15 provided thereon.

As shown in FIG. 1, the releasing rib 17 is capable of fitting into a recess 38 formed in the female housing 20. When the releasing rib 17 is inserted into the recess 38, this releasing rib 17 engages with a stopper arm 45 of the detecting member 40 that is located so as to protrude into the recess 38 (see FIG. 14). Like the guiding ribs 14 and 16, the releasing rib 17 also has a guiding function.

Figure 8:
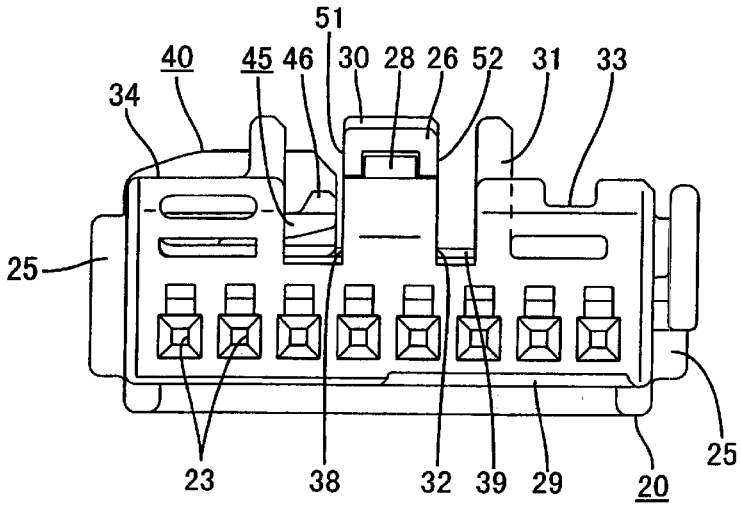
FIG. 8 is a front view of a female housing.

As shown in FIG. 8, the female housing 20 is approximately block-like, and can be fitted into the hood 11 of the male housing 10. As shown in FIG. 4, the area labelled with the letter R forms a fitting area R of the female housing 20 relative to the hood 11. As shown in FIGS. 2 and 8, eight cavities 23 are formed in the female housing 20, these corresponding in location to the male terminal fittings 12 and being capable of housing female terminal fittings 22 that are joined to the ends of electric wires 21. Through holes 24 intersect with each of the cavities 23 within the female housing 20, a retainer (not shown) being attached via these through holes 24 and maintaining the female terminal fittings 22 in an unremovable state. As shown in FIG. 8, a tapered contact releasing member 29 is formed at a right half of a lower face of an anterior portion of the female housing 20. This contact releasing member 29 makes contact with resilient contacts 62 of the shorting terminal 60 (to be described). A pair of fitting operating members 25 protrude from both side faces of the female housing 20. These are used to perform the fitting operation of the female housing 20 and the male housing 10.

As shown in FIGS. 1 and 2, the cantilevered locking arm 26 is provided at a central portion of an upper face of the female housing 20. This locking arm 26 extends along the fitting direction of the two housings 10 and 20, a base end thereof being formed at an anterior end portion of the female housing 20, and a free end thereof extending towards the posterior. A posterior end face of the locking arm 26 is even with a posterior end face of the female housing 20. From its free state, the locking arm 26 can be bent in an up-down direction, the base end serving as its fulcrum, and entering a bending space 27 formed below this locking arm 26.

Figure 13:
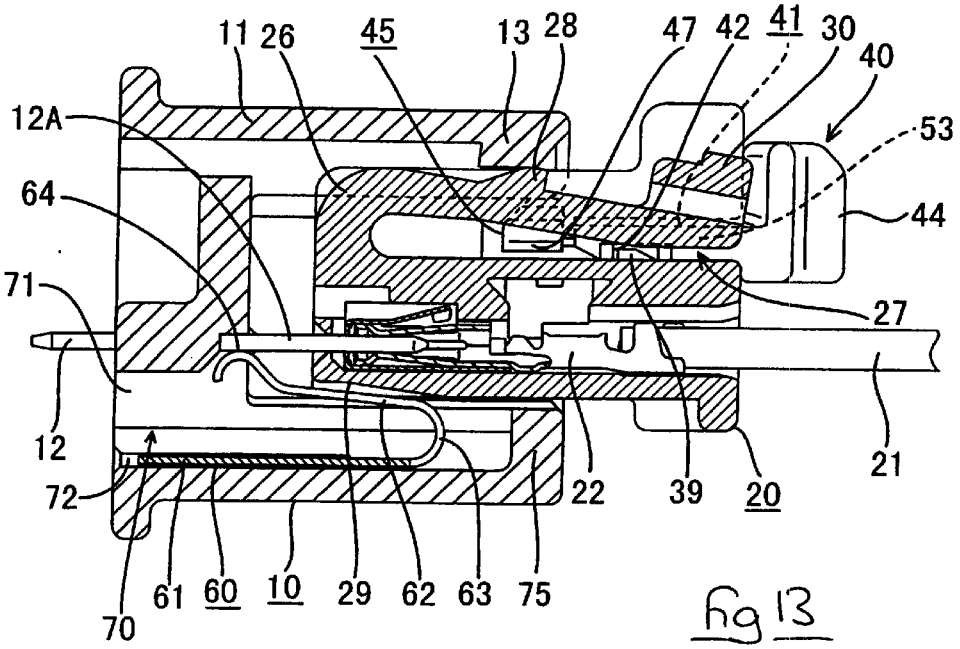
FIG. 13 is a cross-sectional view showing the two housings of FIG. 2 being fitted together.
Figure 16:
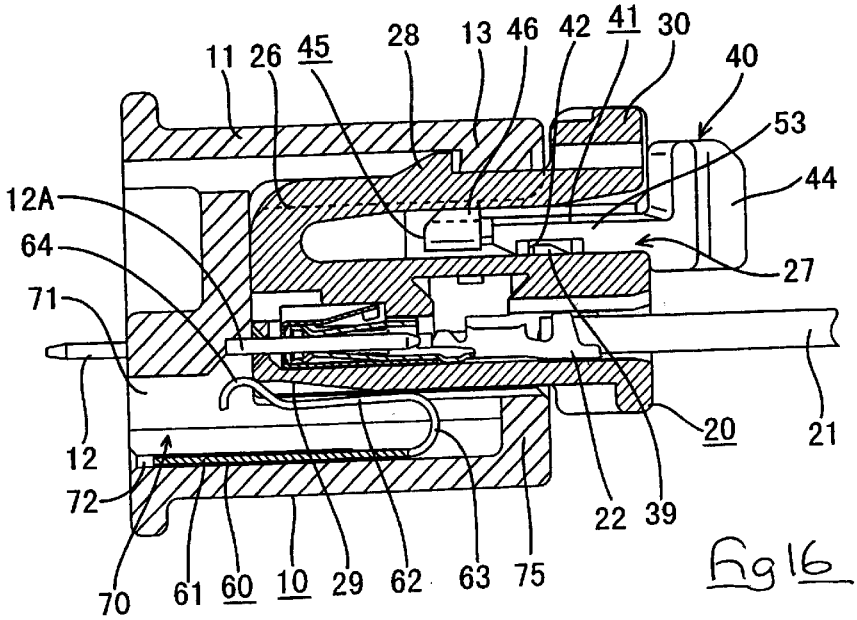
FIG. 16 is a cross-sectional view showing the two housings of FIG. 2 fitted together.

A locking protrusion 28 is formed at an approximately central location (relative to the lengthwise direction) of an upper face of the locking arm 26. This locking protrusion 28 engages with the locking claw 13 of the male housing 10. As shown in FIG. 13, while the two housings 10 and 20 are being fitted together, a tapered face formed at an anterior end face of the locking protrusion 28 makes contact with the locking claw 13, this causing the locking arm 26 to bend downwards. As shown in FIG. 16, when the fitting operation is completed, the locking protrusion 28 catches with the locking claw 13, thereby maintaining the two housings 10 and 20 in a fitted state. An upper face of the free end of the locking arm 26 has a pushing operating member 30 protruding therefrom. Pushing this pushing operating member 30 causes the locking arm 26 to bend.

A side wall 31 is provided to the left side (relative to FIG. 9) of the locking arm 26, being separated by a specified distance therefrom. The space between the locking arm 26 and the side wall 31 forms the guiding groove 32 into which the guiding rib 14 of the male housing 10 fits. A guiding groove 33 is formed to the left of the side wall 31, the guiding rib 16 of the male housing 10 fitting therein.

A surrounding wall 34 is formed at the right side (relative to FIG. 9) of the locking arm 26, being separated by a specified distance therefrom. The space between the locking arm 26 and the surrounding wall 34 forms the recess 38, the releasing rib 17 of the male housing 10 fitting therein. The surrounding wall 34 is provided with a base member 35 at the right side of the female housing 20. The surrounding wall 34 extends upwards to a specified height from the base member 35, and then bends over at an approximate right angle towards the left to form a ceiling member 36, thereby having a cross-sectionally L-shape. As shown in FIG. 10, the space between the base member 35 and the ceiling member 36 forms a housing space 37 within which the detecting member 40 can be attached.

Figure 9:
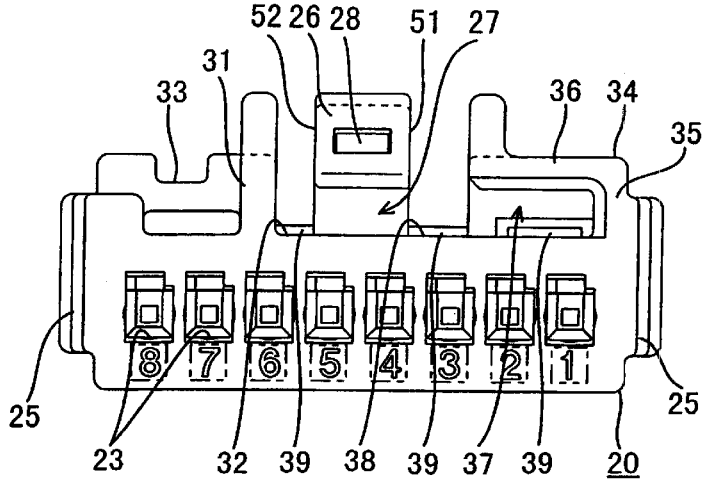
FIG. 9 is a rear face view of the female housing.
Figure 10:
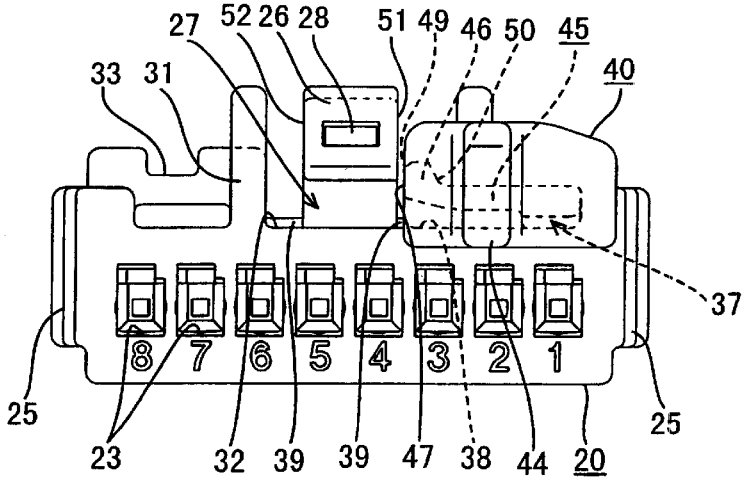
FIG. 10 is a rear face view of the female housing showing a detecting member in an attached state.
Figure 11:
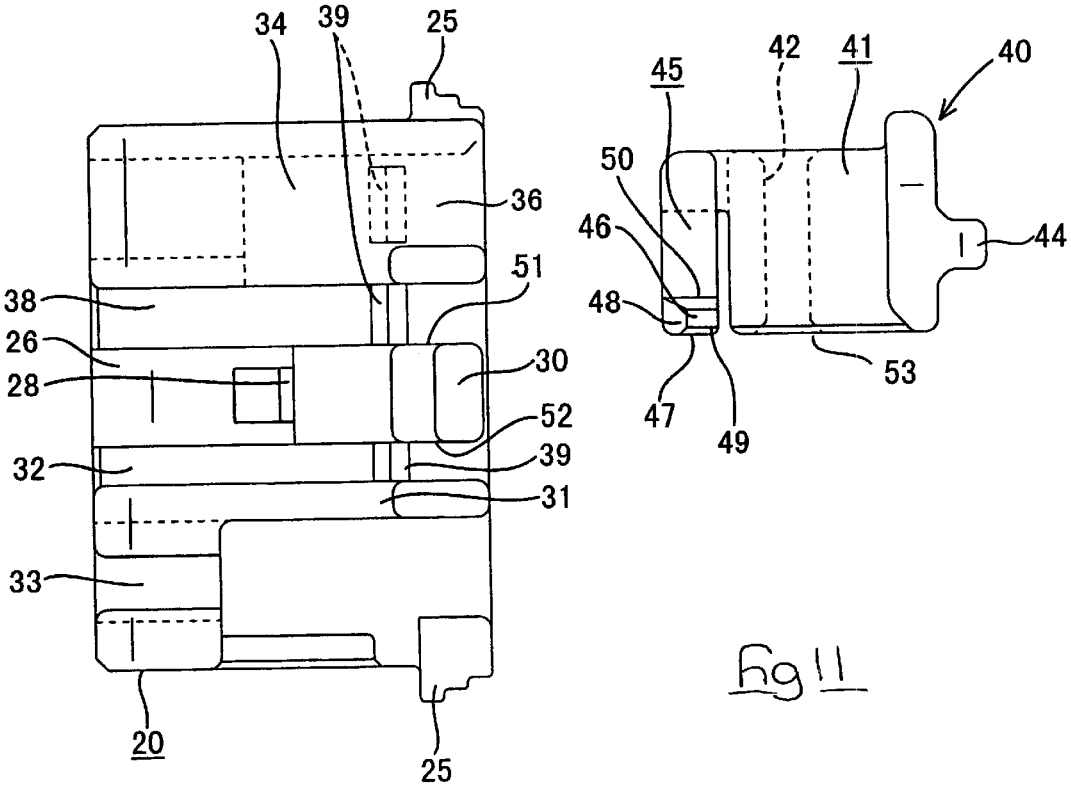
FIG. 11 is a plan view of the female housing and the detecting member.

As shown in FIGS. 9 and 11, the upper face of the female housing 20, which has the guiding groove 32, the recess 38, and the housing space 37 provided thereon, is provided with a protruding member 39 extending along a widthwise direction thereof. This protruding member 39 is divided into three portions that are formed along a straight line.

Figure 20:
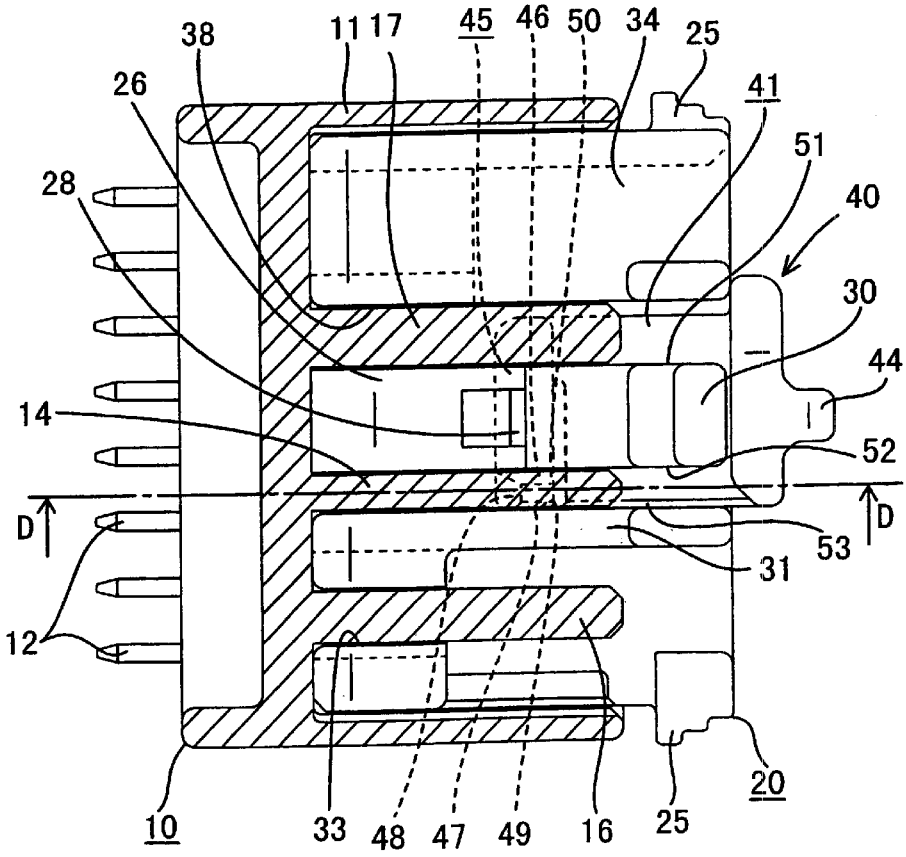
FIG. 20 is a partially cut-away plan view showing the detecting member in a state whereby it has been moved.

As shown in FIG. 1, after the detecting member 40 has been attached to the female housing 20, it is located so as to straddle the housing space 37 and the recess 38, and is capable of moving in the widthwise direction of the female housing 20, that is, in a direction intersecting with the fitting direction of the two housings 10 and 20. As shown in FIG. 20, after the detecting member 40 has been moved, it is located so as to extend from the recess 38 to the guiding groove 32.

Figure 3:
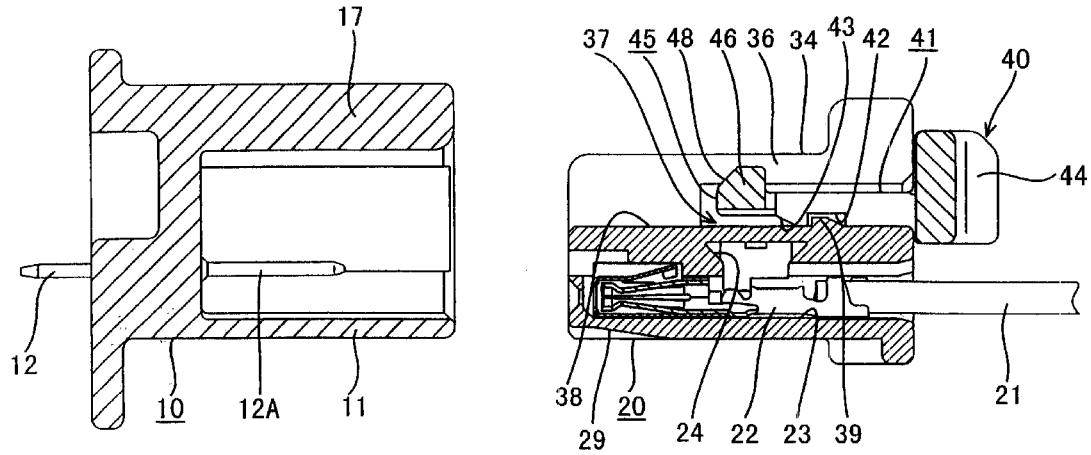
FIG. 3 is a cross-sectional view along the line B—B of FIG. 1.
Figure 12:
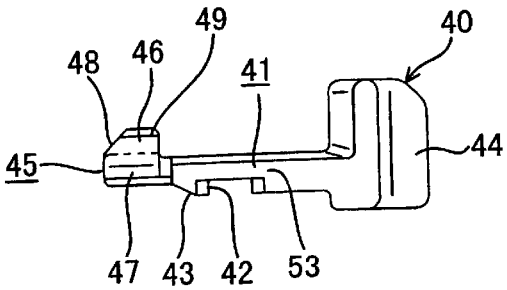
FIG. 12 is a front view of the detecting member.

As shown in FIGS. 1 and 11, the detecting member 40 has a plate-like main body 41 that extends across the upper face of the female housing 20. The stopper arm 45 is formed at an anterior side of this main body 41, and an operating member 44 is formed at a posterior side thereof. As shown in FIGS. 11 and 12, a groove 42 extends along a lower face of the main body 41, this extending in the widthwise direction of the female housing 20, that is, in the direction of movement of the detecting member 40. The protruding member 39 provided on the upper face of the female housing 20 fits into this groove 42. A tapered face 43 is formed at an anterior portion of a lower face of the groove 42. When the detecting member 40 is to be attached to the female housing 20, this tapered face 43 allows the main body 41 to rise easily over the protruding member 39 (see FIG. 3). The fitting together of the groove 42 and the protruding member 39 guides the detecting member 40 when it is being moved in the widthwise direction relative to the female housing 20. Moreover, as shown in FIG. 3, the fitting together of the groove 42 and the protruding member 39 prevents the detecting member 40 from moving to the anterior or the posterior.

As shown in FIG. 1, when the detecting member 40 is in an attached state with the female housing 20, the operating member 44 provided at the posterior of the main body 41 protrudes from the posterior end face of the female housing 20, this allowing the operator to grip the operating member 44 and move the detecting member 40.

As shown in FIGS. 11 and 12, the stopper arm 45 at the anterior of the main body 41 is formed in a cantilevered shape, a base end thereof joining with the end portion of the main body 41 that is farthest from the locking arm 26, and a free end thereof extending in the widthwise direction of the female housing 20 (the direction intersecting with the fitting direction of the two housings 10 and 20). The free end of the stopper arm 45 is level with a side face 53 of the main body 41, this side face 53 facing the locking arm 26. The stopper arm 45 is capable of bending in the same direction as the stopper arm 26, with the base end thereof serving as the fulcrum. As shown in FIG. 10, when the detecting member 40 is in an attached state with the female housing 20, an upper face of the stopper arm 45 is located somewhat below a lower face of the locking arm 26. Further, as shown in FIG. 1, the stopper arm 45 is located to the posterior relative to the locking protrusion 28 of the locking arm 26.

Figure 15:
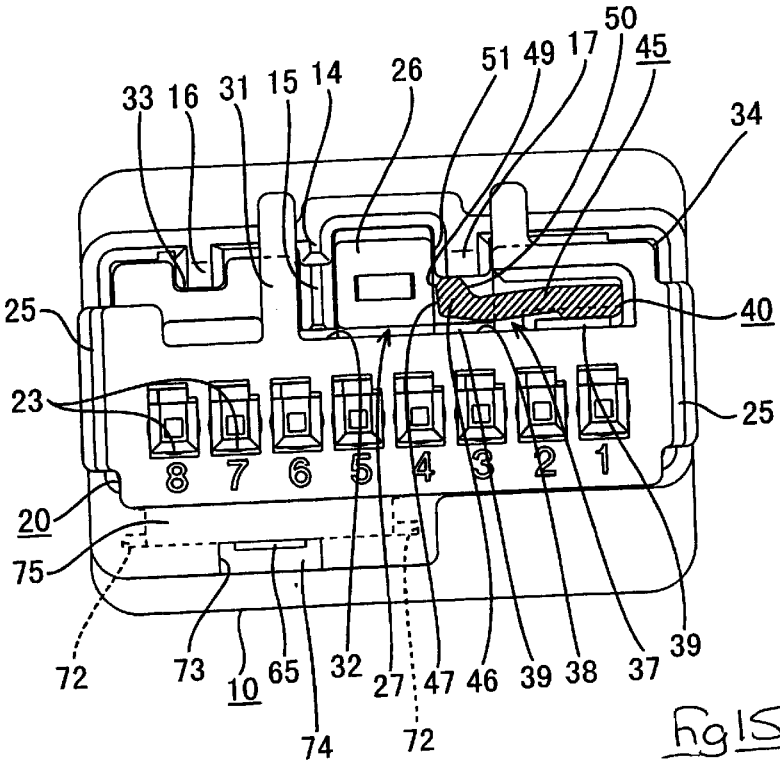
FIG. 15 is a partially cut-away rear face view showing the two housings being fitted together.

As shown in FIG. 12, a detecting protrusion 46 protrudes from an upper face of the free end of the stopper arm 45. As shown in FIGS. 1 and 10, when the detecting member 40 is in an attached state with the female housing 20, the detecting protrusion 46 of the free end of the stopper arm 45 protrudes into the recess 38. A left side face (relative to FIG. 10) of the detecting protrusion 46 forms a contacting face 47 that makes contact with a right side face 51 of the locking arm 26, this contact preventing the detecting member 40 from moving towards the left (relative to FIG. 10). As shown in FIG. 12, an anterior end face of the detecting protrusion 46 forms a guiding face 48 that is inclined upwards towards the posterior. As shown in FIG. 15, the releasing rib 17 of the male housing 10 that is fitted into the concave member 38 engages with the guiding face 48, thereby causing the stopper arm 45 to bend.

As shown in FIGS. 13 and 15, the detecting member 40 makes contact with the bent locking arm 26 in the following manner: the contacting face 47 of the detecting protrusion 46 of the stopper arm 45 (this having been bent in the same direction as the locking arm 26) makes contact with the side face 53 of the main body 41, the contacting face 47 and the side face 53 forming a unified face.

Figure 19:
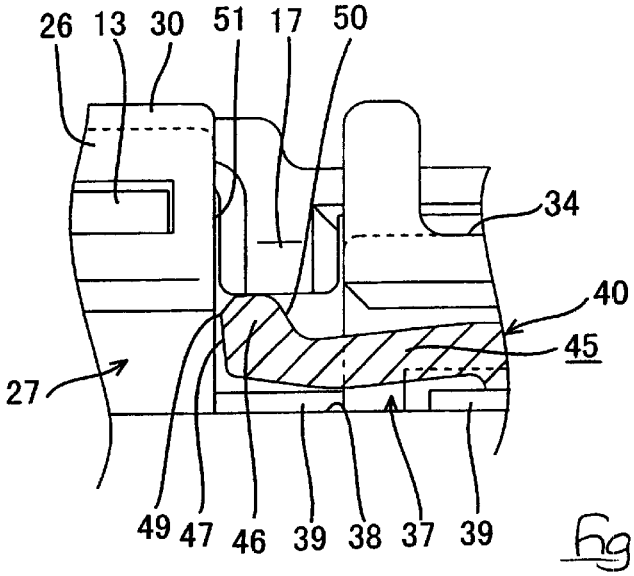
FIG. 19 is a partially cut-away expanded rear face view showing the detecting member and a side face of a locking arm in a catching state.

As shown in FIG. 19, the bent stopper arm 45 is maintained at a height, relative to the locking arm 26 which has returned to its original position, such that the stopper arm 45 can enter the bending space 27. An upper corner 49 of the contacting face 47 of the detecting protrusion 46 catches slightly with the side face 51 of the locking arm 26. In this state, the detecting member 40 cannot move unless a force that exceeds a specified force is exerted on the operating member 44.

When the detecting member 40 has been moved to the position shown in FIG. 21, the stopper arm 45 straddles the bending space 27 below the locking arm 26 and extends across the concave member 38 and the guiding groove 32. As shown in FIG. 22, the detecting protrusion 46 is located in the guiding groove 32 and is housed within the cut-away portion 15 of the guiding rib 14 of the male housing 10. At this juncture, a right (relative to FIG. 21) side face of the detecting protrusion 46 catches with a left side face 52 of the locking arm 26, thereby preventing the detecting member 40 from moving towards the right. This right side face of the detecting protrusion 46 forms a catching member 50.

Now the configuration of the shorting terminal 60 and the shorting terminal housing recess 70 (both of the male housing 10) will be described (see FIGS. 4 and 7).

As shown in FIG. 4, the shorting terminal 60 is provided with a plate-shaped base member 61. Four resilient contacts 62 are provided on an anterior end of this base member 61. The pitch between each resilient contact 62 is the same as the pitch between the male terminal fittings 12. As shown in FIG. 7, base portions of the resilient contacts 62 are bent over towards the posterior in a U-shape, this forming bent portions 63 that comprise anterior ends of the shorting terminal 60. After the bent portions 63 have been inclined so as to extend upwards, the free end portions of the resilient contacts 62 form an angled shape, the peaks thereof forming contacting members 64 that make contact with the tab-shaped anterior portions 12A of the male terminal fittings 12 that protrude into the hood 11. Bending the resilient contacts 62 downwards separates them from the male terminal fittings 12. A stopping member 65 is formed by cutting away, in a downwards direction, a central portion (relative to the widthwise direction) of the base member 61.

Figure 5:
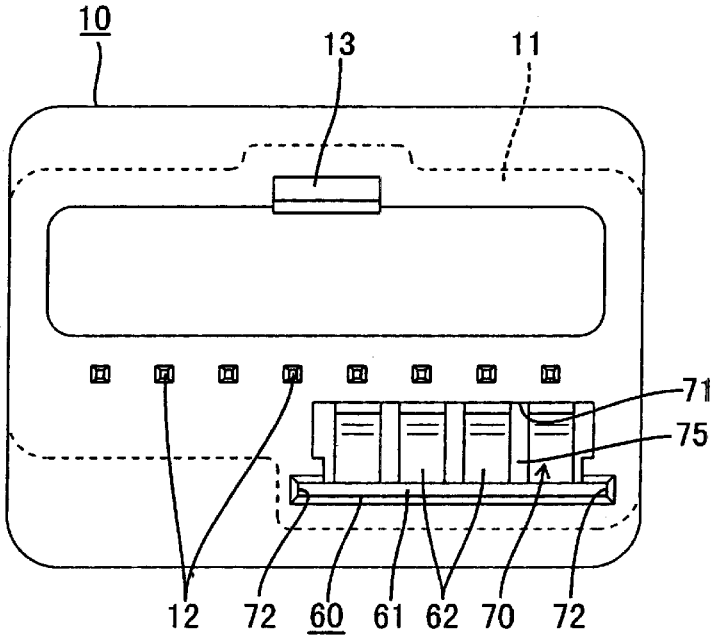
FIG. 5 is a rear face view of the male housing.
Figure 6:
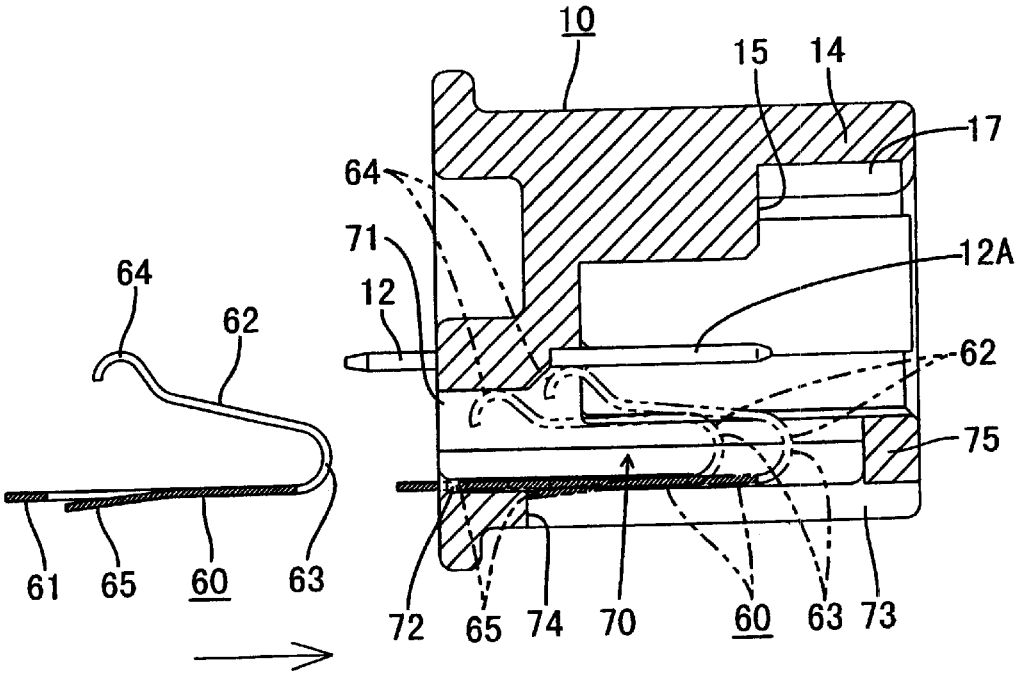
FIG. 6 is a cross-sectional view along the line C—C of FIG. 4 showing the attachment operation of a shorting terminal.

As shown in FIGS. 5 and 7, a posterior end of the shorting terminal housing recess 70 is open to the posterior, forming an attachment hole 71. As shown in FIG. 6, the shorting terminal 60 is inserted from the posterior of the male housing 10 into the shorting terminal housing recess 70 via this attachment hole 71. As shown in FIGS. 5 and 6, a pair of attachment grooves 72 extend for a specified length along a lower edge of the shorting terminal housing recess 70, these attachment grooves 72 opening to the poster of the male housing 10. Both edge portions of the base member 61 of the shorting terminal 60 can be inserted into the attachment grooves 72. As shown in FIG. 7, a cut-away portion 73 is formed in a lower wall of the shorting terminal housing recess 70 in the left half of the lower portion of the hood 11, this cut-away portion 73 being formed at a central portion of the shorting terminal housing recess 70 relative to the widthwise direction thereof. A posterior end face of the cut-away portion 73 forms a retaining member 74, the stopping member 65 of the base member 61 of the shorting terminal 60 engaging therewith and thereby maintaining the shorting terminal 60 in an unremovable state.

As shown in FIG. 4, the shorting terminal housing recess 70 is formed in the downwardly protruding portion of the hood 11. Consequently, it is provided to the exterior of the fitting area R of the corresponding female housing 20. As a result, the only portions of the shorting terminal 60 that are located within the fitting area R of the female housing 20 are the contacting members 64 of the resilient contacts 62. As shown in FIG. 13, the tapered contact releasing member 29 formed at the lower face of the female housing 20 (this being fitted into the hood 11) makes contact with the resilient contacts 62 protruding into the fitting area R, the contact releasing member 29 pushing the resilient contacts 62 in a direction separating them from the male terminal fittings 12.

As shown in FIGS. 4 and 7, a misalignment preventing wall 75 protrudes upwards along the entire length of the anterior end of the lower wall of the shorting terminal housing member 70. A protruding anterior end face of this misalignment preventing wall 75 forms a unified face with an inner face of a right half (relative to FIG. 4) of a lower portion of the hood 11, and joins therewith. The protruding anterior end face of the misalignment preventing wall 75 is located in a position whereby it forms an approximately unified face with the fitting area R of the female housing 20. That is, the misalignment preventing wall 75 causes an opening area of a fitting end face of the male housing 10 to have approximately the same shape as the fitting area R of the female housing 20. As a result, the misalignment preventing wall 75 regulates the fitting movement of the female housing 20 when it is to be fitted into the hood 11.

The present embodiment is configured as described above. Next, the operation thereof will be described. The shorting terminal 60 is attached to the male housing 10 before the two housings 10 and 20 are fitted together. As shown in FIG. 6, the shorting terminal 60 is inserted from the posterior of the male housing 10 into the shorting terminal housing recess 70 via the attachment hole 71.

Both edge portions of the base member 61 of the shorting terminal 60 are inserted into the attachment grooves 72 while the posterior end portion of the base member 61 is being pushed by a jig or the like. This pushes the shorting terminal 60 towards the anterior. The resilient contacts 62 are bent downwards, being guided by the posterior end portions of the male terminal fittings 12 and an upper portion of a hole edge of the attachment hole 71. As they pass through the attachment hole 71, the stopping member 65 of the base member 61 is guided upwards by a lower portion of the hole edge of the attachment hole 71. As shown in FIG. 7, the shorting terminal 60 is inserted to a depth whereby a posterior end of the stopping member 65 of the base member 61 reaches the cut-away portion 73, the attachment of the shorting terminal 60 being completed when the stopping member 65 has engaged with the retaining member 74, the shorting terminal 60 being maintained in a state whereby it cannot be removed from the shorting terminal housing recess 70. At this juncture, the contacting members 64 of the resilient contacts 62 make contact with the tab-shaped anterior portions 12A of the male terminal fittings 12, thereby bringing the four male terminal fittings 12 located at the left side relative to FIG. 4 into a short-circuiting state.

Since the shorting terminal 60 has been attached to the posterior of the male housing 10 in the manner described above, an attaching jig does not interfere with the tab-shaped anterior portions 12A of the male terminal fittings 12 located at the innermost portion of the hood 11. Consequently, the jig cannot cause the male terminal fittings 12 to bend. Furthermore, the misalignment preventing wall 75 protrudes at the anterior end of the shorting terminal housing recess 70, this making it difficult to attach the shorting terminal 60 from the anterior. In contrast, the shorting terminal 60 can easily be inserted from the opposite side into the shorting terminal housing recess 70 via the attachment hole 71. Consequently, the shorting terminal 60 can easily be attached. Moreover, the bent portions 63 are provided on the anterior side (relative to the attaching direction) of the resilient contacts 62 of the shorting terminal 60. Consequently, when the shorting terminal 60 is being attached, the posterior end portion of the base member 61 thereof can be pressed by a jig without this jig coming into contact with the resilient contacts 62.

When the shorting terminal 60 is attached to the male housing 10, since the misalignment preventing wall 75 is located to the anterior thereof, the shorting terminal 60 is not exposed to the exterior too much. As a result, when the male housing 10 stands alone as a single unit before the two housings 10 and 20 are fitted together, foreign objects are prevented from entering therein from the anterior and striking against the shorting terminal 60. That is, the shorting terminal 60 is protected by the misalignment preventing wall 75.

Next, the two housings 10 and 20 are fitted together. From the state shown in FIG. 2, the female housing 20 is fitted into the hood 11 of the male housing 10. As shown in FIG. 4, the opening area of the fitting end face of the male housing 10 and the fitting area R of the female housing 20 have approximately the same shape. Consequently, if the female housing 20 is inserted into the hood 11 with its anterior face in an inclined state, this inclined state is corrected, and the female housing 20 is inserted correctly into the hood 11.

As shown in FIG. 13, the anterior portions 12A of the male terminal fittings 12 make contact with the female terminal fittings 22 as fitting progresses, and the locking claw 13 of the male housing 10 engages with the tapered face of the locking protrusion 28 of the female housing 20, this causing the locking arm 26 to bend into the bending space 27 provided therebelow. The contacting face 47 at the left side of the detecting protrusion 46 of the stopper arm 45 (this being in a free state) makes contact with the right side face 51 of the locking arm 26 (this being in a bent state), and the right side face 51 also making contact with the side face 53 of the main body 41, thereby preventing the detecting member 40 from moving towards the left.

Figure 14:
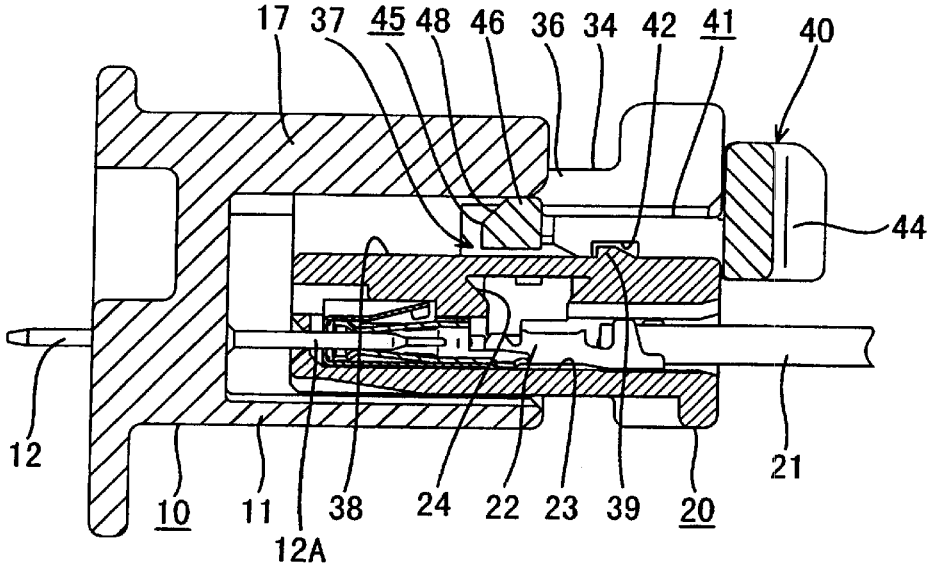
FIG. 14 is a cross-sectional view showing the two housings of FIG. 3 being fitted together.

As shown in FIG. 14, after the locking arm 26 has been bent, the releasing rib 17 that has been fitted into the recess 38 engages with the guiding face 48 of the detecting protrusion 46 of the stopper arm 45 (the detecting protrusion 46 is located to the posterior relative to the locking protrusion 28; see FIG. 1 for the positional relationship between the two). The guiding face 48 guides the detecting protrusion 46 below the releasing rib 17; this causes the stopper arm 45 to bend downwards. At this juncture, as shown in FIG. 15, the contacting face 47 of the detecting protrusion 46 and the side face 53 of the main body 41 make contact with the side face 51 of the bent locking arm 26, thereby keeping the detecting member 40 from moving towards the left.

As shown in FIG. 16, as the fitting progresses further, the contact releasing member 29 of the female housing 20 makes contact with the resilient contacts 62 of the shorting terminal 60. The resilient contacts 62 bend downwards as they are pushed by the contact releasing member 29, the contacting members 64 thereby being separated from the anterior portions 12A of the male terminal fittings 12. In this manner the short-circuiting state of these four male terminal fittings 12 is released.

Figure 17:
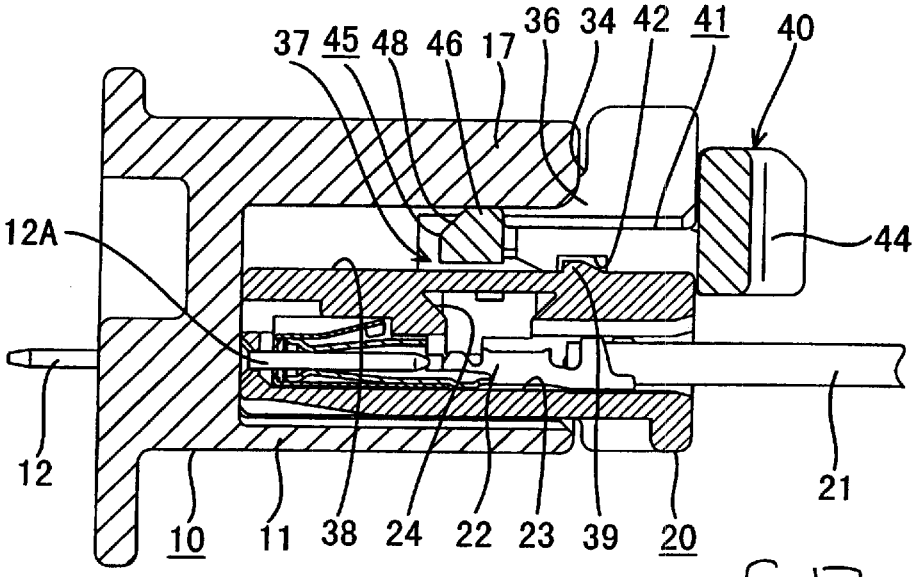
FIG. 17 is a cross-sectional view showing the two housings of FIG. 3 fitted together.
Figure 18:
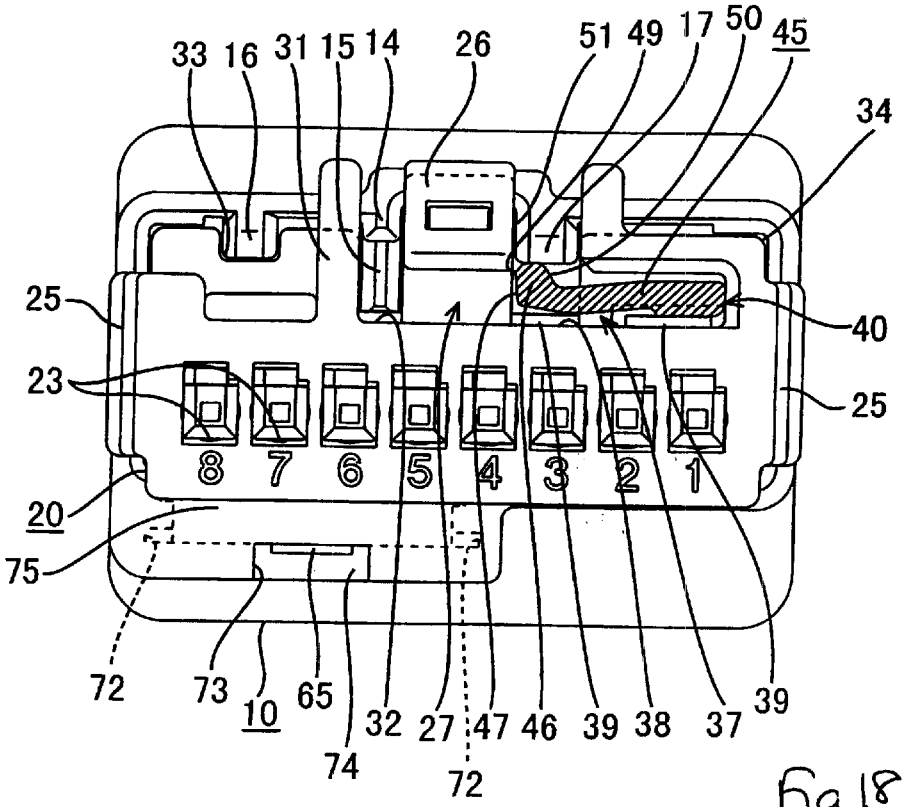
FIG. 18 is a partially cut-away rear face view showing the two housings fitted together.

As the fitting of the two housings 10 and 20 is completed, the locking protrusion 28 engages with the anterior side of the locking claw 13, and the locking arm 26 bends upwards out of the bending space 27. At this juncture, the contacting state of the side face 53 of the main body 41 and the side face 51 of the locking arm 26 is released. As shown in FIGS. 17 and 18, the detecting protrusion 46 is pushed downwards by the releasing rib 17, which maintains the stopper arm 45 in a bent-down state at a height allowing it to be inserted into the bending space 27 below the locking arm 26 (this locking arm 26 having returned to its original position). As shown in FIG. 19, the upper corner 49 of the contacting face 47 of the detecting protrusion 46 catches with the side face 51 of the locking arm 26 that has returned to its original position, this allowing them to be separated easily.

From this state, pushing the operating member 44 of the detecting member 40 towards the left causes the catching state of the corner 49 of the detecting protrusion 46 with the side face 51 of the bent locking arm 26 to be completely released, allowing the detecting member 40 to be moved towards the left. At this juncture, a force exceeding a specified amount must be exerted on the operating member 44 to move the detecting member 40. Consequently, the operator can determine that the detecting member 40 has been moved. Furthermore, the degree of force required is not so great as to impede the smooth movement of the detecting member 40.

The movement of the detecting member 40 is guided by the protruding member 39 of the female housing 20 which fits with the groove 42 of the detecting member 40. When the detecting member 40 is to be moved, the stopper arm 45, in the bent state shown in FIG. 18, is passed through the bending space 27 below the locking arm 26, the detecting protrusion 46 at the tip of the stopper arm 45 passing through this bending space 27. When it has reached the guiding groove 32 located to the left, the detecting protrusion 46 moves upwards and the stopper arm returns to its original position (see FIG. 21). As shown in FIG. 22, the detecting protrusion 46 that is located within the guiding groove 32 is housed within the cut-away portion 15 of the guiding rib 14 of the male housing 10. Since the stopper arm 45 has returned to its original state, set-in fatigue does not occur.

Figure 21:
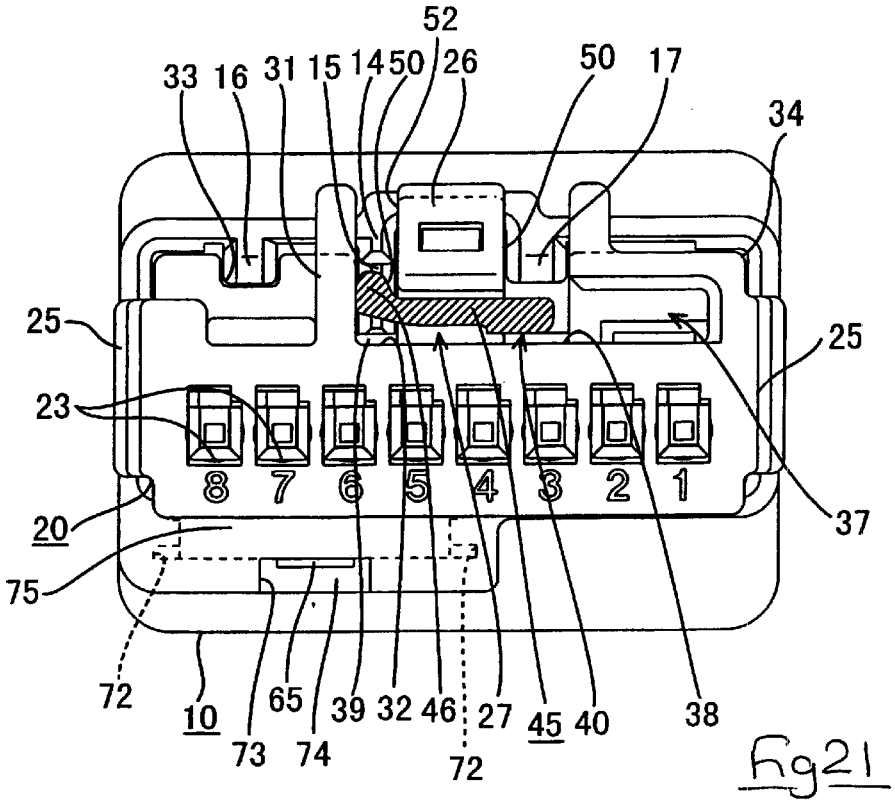
FIG. 21 is a partially cut-away rear face view showing the detecting member in the state whereby it has been moved.
Figure 22:
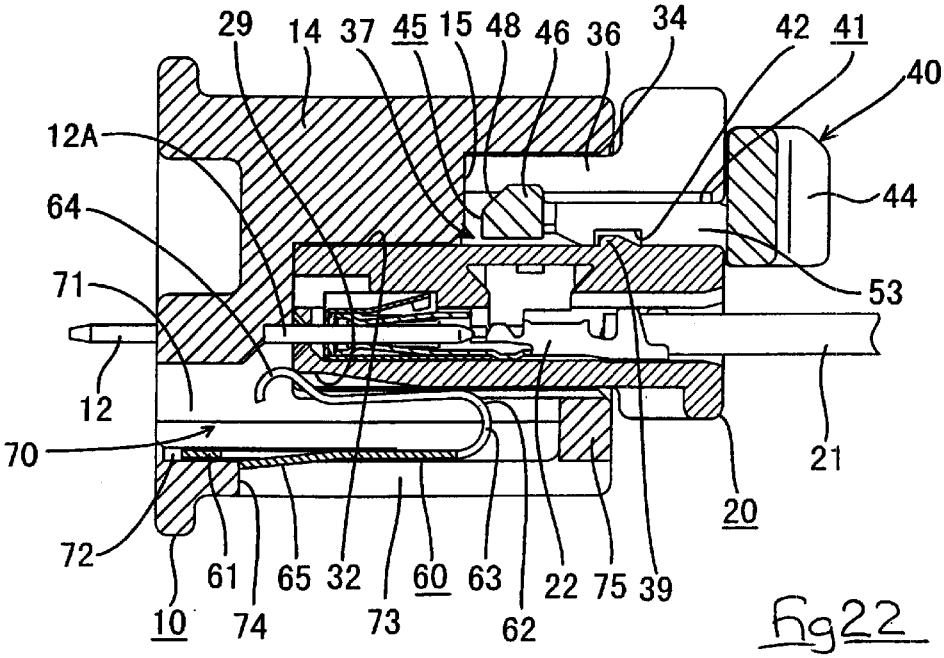
FIG. 22 is a cross-sectional view along the line D—D of FIG. 20.
Figure 23:
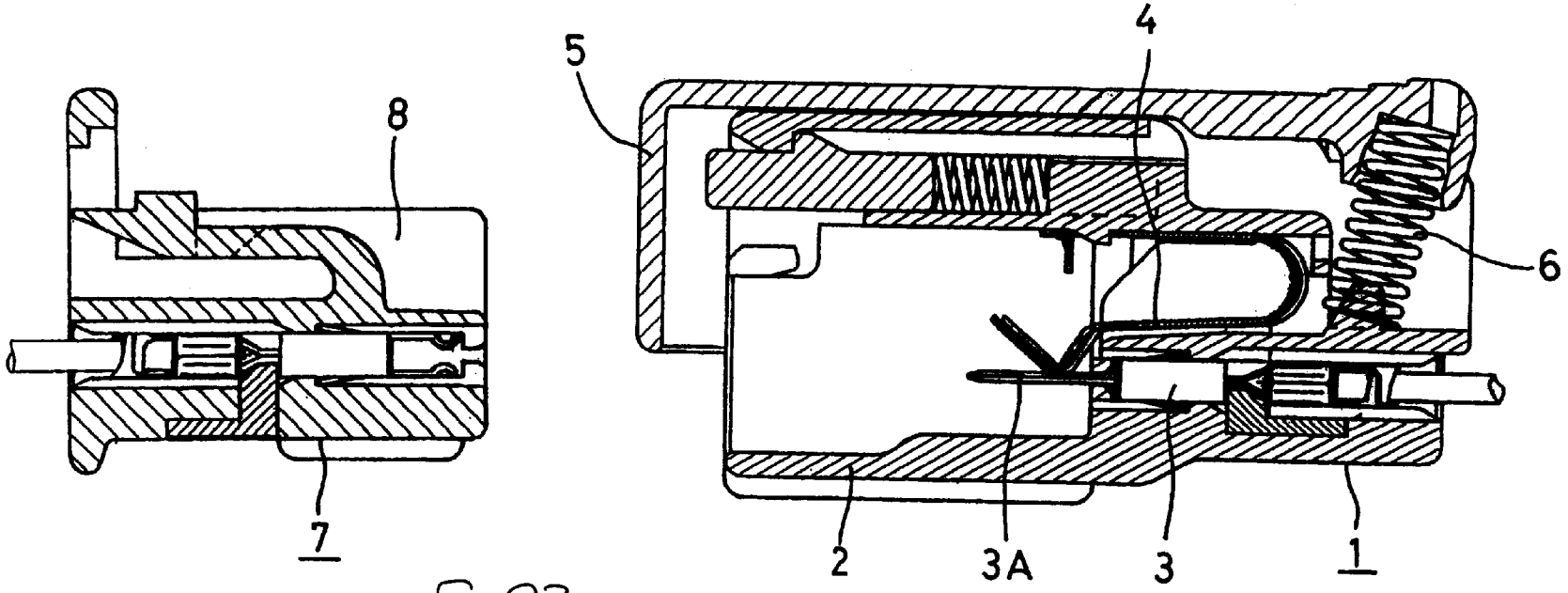
PRIOR ART Fig 23
FIG. 23 is a side cross-sectional view of a prior art example.

As shown in FIG. 21, the catching member 50 at the right of the detecting protrusion 46 catches with the left side face 52 of the locking arm 26. As a result, the detecting member 40 is prevented from moving even if a force pushing it towards the right is mistakenly applied thereto. Moving the detecting member 40 to the position shown in FIGS. 20 and 21, in the manner described above, allows one to ascertain that the two housings 10 and 20 have been correctly fitted together.

The two housings 10 and 20 may need to be separated for maintenance or the like. In such a case, a jig is first used to bend the stopper arm 45, releasing the catching member 50 of the detecting protrusion 46 from its catching state with the side face 52 of the locking arm 26, the detecting member 40 returning to its original position (see FIG. 18). After the detecting member 40 has left the bending space 27, the pushing operating member 30 is pushed downwards, causing the locking arm 26 to bend downwards. As a result, the engaged state of the locking protrusion 28 with the locking claw 13 is released, and the two housings 10 and 20 can be separated. As the two housings 10 and 20 are separated, the resilient contacts 62 of the shorting terminal 60 again make contact with the anterior portion 12A of the male terminal fittings 12.

In the embodiment described above, the misalignment preventing wall 75 is provided at the anterior end of the shorting terminal housing member 70. Consequently, the opening area of the hood 11 of the male housing 10 can be the minimum required to allow the female housing 20 to fit therein. Moreover, the fitting position of the female housing 20 is regulated when the two housings 10 and 20 are to be fitted together. Furthermore, the shorting terminal 60 is protected by the misalignment preventing wall 75 when the male housing 10 is still a single unit. That is, the misalignment preventing wall 75 has two functions; it increases the stability of the fitted female housing 20, and it protects the shorting terminal 60. The configuration used to add these two functions to the connector remains simple.

The shorting terminal 60 can be attached to the male housing 10 from the posterior, via the attachment hole 71. As a result, the jig used for attaching the shorting terminal 60 cannot accidentally enter the hood 11 and make contact with the anterior portions 12A of the male terminal fittings 12 protruding into the hood 11. Consequently, the jig cannot bend the male terminal fittings 12 accidentally.

The present invention is not limited to the embodiments described above with the aid of figures. For example, the possibilities described below also lie within the technical range of the present invention. In addition, the present invention may be embodied in various other ways without deviating from the scope thereof.

(1) In the embodiment described above, when the shorting terminal is to be attached to the male housing, the posterior end portion of the base member thereof is pushed by a jig. However, the posterior end portion of the base member may equally well be provided with, for example, a bent portion protruding upwards at a right angle, the attachment operation being performed by pressing a posterior face of this bent portion with the jig. This would increase the contact area for the jig, thereby making the attachment operation easier.

(2) In the embodiment described above, the shorting terminal is attached to the male housing. However, the present invention is equally suited for a case whereby the shorting terminal is attached to the female housing. That is, a type of connector whereby the male housing is fitted within a hood of the female housing is equally suitable.

What is claimed is:

1. An electrical connector comprising a first housing having an integral hood defining an open space;

a second housing insertable into the open space in a fitting direction and to a fully fitted condition wherein a substantial portion of the second housing is received into the open space defined by the hood;

a plurality of terminal fittings disposed in the first housing and protruding into said open space;

a resilient shorting terminal disposed in the first housing and having a bend and one or more resilient contacts, said shorting terminal being in contact with two or more of said terminal fittings, and said shorting terminal being adapted to be separated from said terminal fittings when said second housing is in said fully fitted condition; and a wall at the mouth of said hood, said wall being integral with the hood and extending into said hood substantially transverse to said fitting direction, said wall overlapping said shorting terminal in a direction transverse to said fitting direction and shielding substantially the entire bend of said shorting terminal, and said wall tending to align the second housing during insertion into the open space.

2. A connector according to claim 1 wherein said shorting terminal is "C" shaped, the bend is adjacent said wall and one arm of the shorting terminal comprises a resilient shorting member for said terminal fittings.

3. A connector according to claim 1 wherein said first housing includes an insertion aperture for said shorting terminal, said aperture facing outwards in the opposite direction to said hood and facilitating installation of the shorting terminal from a posterior face of the first housing.

4. A connector according to claim 3 wherein said aperture defines the mouth of an insertion recess extending in said fitting direction, said recess having guide grooves on opposite sides thereof and extending in the fitting direction, and said shorting terminal being engageable in said guide grooves.

5. An electrical connector comprising a first housing having an integral hood defining an open space;

a second housing insertable into the open space in a fitting direction and to a fully fitted condition wherein a substantial portion of the second housing is received into the open space defined by the hood;

a plurality of terminal fittings disposed in the first housing and protruding into said open space;

a resilient shorting terminal disposed in the first housing and having a bend and one or more resilient contacts, said shorting terminal being in contact with two or mare of said terminal fittings, and said shorting terminal being adapted to be separated from said terminal fittings when said second housing is in said fully fitted condition;

a wall at the mouth of said hood, said wall being integral with the hood and extending into said hood substantially transverse to said fitting direction and shielding substantially the entire bend of said shorting terminal; and an insertion aperture for said shorting terminal disposed in said first housing, said aperture facing outwards in the opposite direction to said hood and facilitating installation of the shorting terminal from a posterior face of the first housing.

6. A connector according to claim 5 wherein said aperture defines the mouth of an insertion recess extending in said fitting direction, said recess having guide grooves on opposite sides thereof and extending in the fitting direction, and said shorting terminal being engageable in said guide grooves.

7. A connector according to claim 6 wherein said shorting terminal is "C" shaped, the bend is adjacent said wall and one arm of the shorting terminal comprises a resilient shorting member for said terminal fittings.

* * * * *

UNITED STATES PATENT AND TRADEMARK OFFICE

CERTIFICATE OF CORRECTION

PATENT NO. : 6,575,775 B2
DATED : June 10, 2003
INVENTOR(S) : Teruaki Hasegawa et al.

It is certified that error appears in the above-identified patent and that said Letters Patent is hereby corrected as shown below:

Title page,
Item [75], Inventors, "Naova" has been replaced with -- Naoya --;

Column 12,
Line 8, "mare" has been replaced with -- more --.

Signed and Sealed this

Twenty-first Day of October, 2003

JAMES E. ROGAN
*Director of the United States Patent and Trademark Office*